US005402802A

United States Patent [19]

Kakiuchi et al.

[11] Patent Number: 5,402,802

[45] Date of Patent: Apr. 4, 1995

[54] POWER TRANSMISSION DEVICE AND A CIGARETTE MOVING DEVICE FOR A FILTER CIGARETTE MANUFACTURING SYSTEM

[75] Inventors: Makoto Kakiuchi; Takayuki Irikura, both of Tokyo, Japan

[73] Assignee: Japan Tobacco Inc., Tokyo, Japan

[21] Appl. No.: 83,174

[22] Filed: Jun. 29, 1993

[30] Foreign Application Priority Data

Jun. 30, 1992 [JP] Japan ..... 4-172677

[51] Int. Cl.[6] ..... A24C 5/47; A24C 5/52

[52] U.S. Cl. ..... 131/94; 74/63

[58] Field of Search ..... 131/94, 904; 73/38; 74/63, 470, 606 R, 607

[56] References Cited

U.S. PATENT DOCUMENTS

| | | | |
|---|---|---|---|
| 2,740,409 | 4/1956 | Korber | 131/94 |
| 2,821,201 | 1/1958 | Brunswig | 131/94 X |
| 3,372,702 | 3/1968 | Bohn et al. | 131/94 |
| 3,412,856 | 11/1968 | Esenweir | 131/904 X |
| 3,769,832 | 11/1973 | Baier | 73/38 X |
| 4,333,335 | 6/1982 | Heitmann et al. | 73/38 X |
| 4,746,006 | 5/1988 | Nixon et al. . | |
| 5,135,008 | 8/1992 | Oesterling et al. | 131/94 |
| 5,186,183 | 2/1993 | Komori et al. | 131/904 X |

FOREIGN PATENT DOCUMENTS

| | | | |
|---|---|---|---|
| 2455438 | 11/1980 | France . | |
| 933437 | 9/1955 | Germany | 131/94 |

*Primary Examiner*—Jennifer Bahr

[57] ABSTRACT

A device is applied to a filter cigarette manufacturing system which includes grooved drums for transporting cigarettes. The device has a rotor located beside the grooved drum so as to be inclined against the same, bellows-type couplings for transmitting a rotatory force from the rotor to the drum, thereby rotating the drum at equal speeds, and pusher drum attached to the rotor and adapted to push out the cigarettes in the axial direction thereof when a predetermined rotational-angle region of the grooved drum is reached by the cigarettes on the drum.

12 Claims, 6 Drawing Sheets

POWER TRANSMISSION DEVICE AND A CIGARETTE MOVING DEVICE FOR A FILTER CIGARETTE MANUFACTURING SYSTEM

BACKGROUND OF THE INVENTION

1. Field of the Invention

The present invention relates to a power transmission device incorporated in a filter cigarette manufacturing system and a device for moving cigarettes or filter cigarettes in the axial direction thereof with the aid of the power transmission device during the manufacture of the filter cigarettes.

2. Description of the Related Art

A filter cigarette manufacturing system or a so-called filter attachment includes a first cutting stage, separation stage, feeding stage, connection stage, second cutting stage, and inspection stage. In the first cutting stage, each two cigarettes are obtained by cutting a cigarette rod twice as long as each cigarette into two equal parts. In the separation stage, the two cigarettes are separated from each other so that a predetermined space is secured between them. In the feeding stage, a filter plug is fed into the space between each two cigarettes. In the connection stage, a paper piece is wound around the two cigarettes and the filter plug to connect them, whereby a double filter cigarette is obtained. In the second cutting stage, the double filter cigarette is cut into two equal parts, that is, two filter cigarettes. These filter cigarettes are checked up in the Inspection stage. These stages are executed in the process of continuously transporting the cigarettes or filter cigarettes on grooved drums while rotating the grooved drums.

In the separation stage, each two cigarettes are moved oppositely to each other in the axial direction thereof, so that the predetermined space for receiving the filter plug is formed between these cigarettes.

In the feeding stage, moreover, the two cigarettes must be moved in the axial direction to be brought into intimate contact with the filter plug.

Also in the inspection stage, the two filter cigarettes are moved oppositely to each other in the axial direction thereof, so that a space for receiving an inspection device is secured between these filter cigarettes.

To attain this, devices for axially moving the cigarettes and filter cigarettes are incorporated in the separation, feeding and inspection stages of the filter attachment. An example of these devices is disclosed in U.S. Pat. No. 4,746,006.

The disclosed moving device comprises a pair of first conical drums which are used to receive each two cigarettes obtained in the first cutting stage. These first conical drums are mounted on a first common sleeve so that their respective axes of rotation are inclined oppositely to each other. Thus, each two cigarettes received individually by the paired first conical drums are axially separated from each other as the drums rotate. The moving device further comprises a pair of second conical drums which are used to receive the cigarettes individually from the first conical drums. The second conical drums have the same shape as the first ones. The paired second conical drums have a function to further separate the two received cigarettes, align them on the same axis, and feed them to the next stage.

According to this disclosed moving device, the axes of rotation of the paired conical drums are inclined, so that a pair of bevel gears, whether spiral or straight, are used not only for transmission of power to one conical drum but also for power transmission between the drums.

The paired bevel gears, for use as power transmission means, are mechanical elements which are suited for equal-speed transmission between members whose axial angles are greatly different. Use of these bevel gears, however, is subject to the following drawbacks.

Working the bevel gears of this type, whose specifications are special, is very difficult. Further, the bevel gears must be designed in accordance with the necessary size of the space between each two cigarettes, that is, the length of the filter plug, so that their costs are very high.

Furthermore, the bevel gears require high-accuracy installation. If the backlash of the paired bevel gears is too small, deterioration of the gears is promoted. If the backlash is too great, on the other hand, there is a difference between the rotational phases of the conical drums, so that the cigarettes cannot be securely delivered between the first cutting stage and the paired first conical drums or between the first and second conical drums.

Shims are used for high-accuracy installation of the bevel gears and the conical drums. Before the gears and the drums are determinately installed with the aid of the shims, however, assembling and disassembling these elements should be repeated many times. Thus, the installation of the conical drums and the bevel gears takes much time and labor.

Since bearings for the bevel gears are subjected to thrust load, the gears must be supported by means of thrust bearings. Inevitably, however, deep-groove ball bearings should be used for the purpose in consideration of ease of maintenance, and these bearings undergo early deterioration.

The tooth surfaces of the bevel gears require protection against dust as well as lubrication. To attain this, a bellows-shaped rubber cover is put on the paired bevel gears so as to conceal them externally.

Since the rubber cover repeatedly extends and contracts as the bevel gears rotate, however, it also undergoes early deterioration. In order to avoid being bit by the bevel gears, moreover, the rubber cover is disposed in sliding contact with a receiving member, so that its deterioration is further accelerated.

If the bearings, rubber cover, or other expendables undergo an impermissible degree of deterioration, they must be replaced with new ones. The replacement of these components requires suspension of the operation of the filter attachment, thus lowering the efficiency of production of the filter cigarettes.

SUMMARY OF THE INVENTION

The object of the present invention is to provide a power transmission device adapted for use in a filter attachment and a cigarette moving device utilizing the power transmission device and enjoying improved assembling capability and operational reliability.

The above object is achieved by a power transmission device according to the present invention. The power transmission device comprises coupling means for coupling first and second rotating members to each other. At least one of the rotating members defines part of the path of transportation of cigarettes or filter cigarettes during the manufacture of the filter cigarettes, and an angle of deviation exists between the respective axes of the first and second rotating members. In order to connect the first and second rotating members to each other, the coupling means includes a bellows for integrally coupling the rotating members with the angle of deviation allowed between them.

Thus, when a rotatory force is applied to one of the rotating members, the coupling means causes the first and second rotating members to rotate at equal speeds by means of the bellows.

The other rotating member of the power transmission device may be provided with a pusher member. As the pusher member extends from the other rotating member to a position right over the outer peripheral surface of the one rotating member or the grooved drum, the power transmission device forms a cigarette moving device.

When a predetermined rotational-angle region of the grooved drum is reached by the cigarettes or filter cigarettes transported on the grooved drum, according to this moving device, the pusher member can contact and push out the cigarettes or filter cigarettes. Thereupon, the cigarettes or filter cigarettes are moved in the axial direction thereof on the grooved drum by the pusher member.

Also, the power transmission device of the present invention may be applied to the aforementioned moving device disclosed in U.S. Pat. No. 4,746,006. In this case, the paired bevel gears of this device are replaced with the coupling means. More specifically, the coupling means is used both for the transmission of power to one of the paired conical drums and for the power transmission between the drums.

The bellows of the coupling means not only allows the angle of deviation between the respective axes of the first and second rotating members, of the grooved drum and the rotating member, or of the paired conical drums, but also absorbs errors in the working and installation accuracy of these rotating elements. Thus, both the aforementioned devices can be easily assembled and disassembled. Requiring neither lubrication nor dust-proof measure, moreover, the bellows of the coupling means can be maintained with ease. Furthermore, the coupling means has an advantage over the bevel gears in not requiring the use of the expendables, such as the bearings, rubber cover, etc.

BRIEF DESCRIPTION OF THE DRAWINGS

The present invention will be more fully understood from the ensuing detailed description and the accompanying drawings, which are given by way of illustration only, and thus, are not limitative of the present invention, and wherein.

DETAILED DESCRIPTION OF THE PREFERRED EMBODIMENTS

Figure 1:
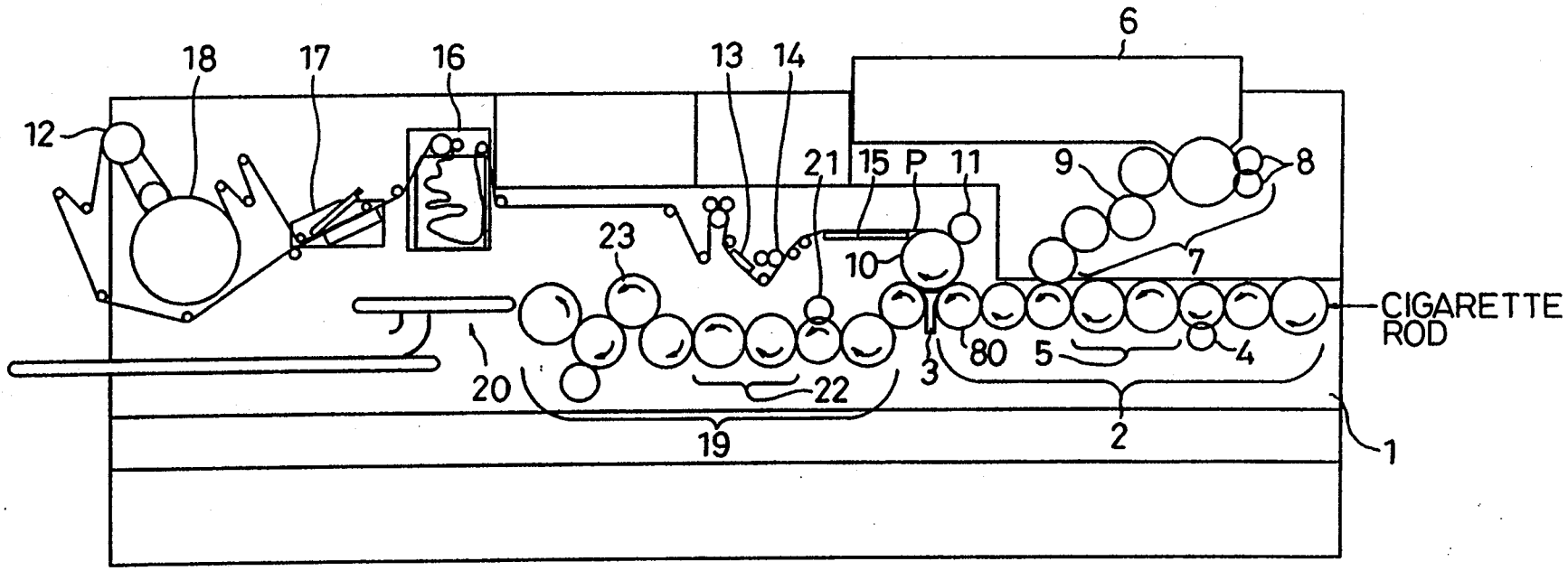
FIG. 1 is a schematic view showing a filter attachment.

Referring to FIG. 1, a filter attachment comprises a main frame 1. In FIG. 1, a drum train 2 is arranged in the right-hand side portion of the main frame 1. The drum train 2 extends to a rolling section 3.

The drum train 2 includes a plurality of grooved drums, which are continuously located so as to be in rolling contact with one another. Each two adjacent grooved drums are rotated in opposite directions at the same peripheral speed.

Cigarette rods, each having a length twice that of a cigarette, are received by the grooved drum at the right-hand end of the drum train 2, that is, by the respective grooves of the grooved drum. As the drums rotate, thereafter, these cigarette rods are successively transferred to the grooves of those drums immediately on the left, and are transported to the rolling section 3.

One of the grooved drums of the drum train 2 is provided with a rotating knife 4. As the cigarette rods are transported on the drums, the knife 4 cuts each rod into two equal parts. Thus, two cigarettes can be obtained from each cigarette rod.

Two grooved drums, which successively adjoin the grooved drum with the rotating knife 4 on the left-hand side and constitute a separating drum assembly 5, include a cigarette moving device. As each two cigarettes pass through the drum assembly 5, therefore, they are separated in the axial direction from each other by the moving device, so that a predetermined space is secured between the two cigarettes. The moving device will be described in detail later.

A filter plug hopper 6 is located over the drum train 2. The hopper 6 and the drum train 2 are connected to each other by means of a drum train 7. More specifically, the drum train 7 connects the hopper 6 and that grooved drum of the drum train 2 which is situated immediately on the left of the separating drum assembly 5.

The drum train 7, like the drum train 2, includes a plurality of grooved drums, which are continuously located so as to be in rolling contact with one another. As the grooved drums of the drum train 7 rotate, filter rods are taken out one after another from the hopper 6, and are transported to the drum train 2.

That grooved drum of the drum train 7 which is situated right under the hopper 6 is provided with, e.g., two rotating knives 8. The next grooved drum which is situated on the lower-course side of this drum serves as a so-called grading drum 9. Thus, each filter rod, taken out from the hopper 6, is divided into, e.g., three individual filter plugs of equal lengths as it passes through the grooved drum with the rotating knives 8 thereon. As the three filter plugs on the same axis pass through the grading drum 9, thereafter, they are rearranged in front and in rear with respect to the transportation direction thereof, and are supplied one by one to the grooved drum of the drum train 2.

Each filter plug supplied to the grooved drum of the drum train 2 is located in a space between each two cigarettes passed through the separating drum assembly 5. Thereupon, the drum train 2 finally supplies the two cigarettes and the filter plug between them, as one intermediate product, to the rolling section 3.

A paper web cutting section is located right over the rolling section 3. The cutting section includes a receiving drum 10 and an edged drum 11 located so as to be in rolling contact with the drum 10. The drum 11 has a plurality of cutter blades (not shown) on the outer peripheral surface thereof. These cutter blades are arranged at regular intervals in the circumferential direction of the edged drum 11.

The receiving drum 10 serves to guide a paper web P, which is paid out from a paper roll 12 at the left-hand end portion of the main frame 1.

A preheater 13, a paster 14, and a post-heater 15 are successively arranged downstream along a feed path for the paper web P, which extends from the paper roll 12 to the receiving drum 10. On the upper-course side of the preheater 13, moreover, a paper reservoir 16 and a connecting device 17 are arranged along the paper web feed path. The connecting device 17 holds one end of the paper web P, which is delivered from the paper roll 18 at the standby.

As the web P is supplied toward the receiving drum 10, therefore, it successively undergoes preheating by means of the preheater 13, one-sided application of paste by means of the paster 14, and drying of the pasted surface by means of the post-heater 15.

The outer peripheral surface of the receiving drum 10 is formed as a suction surface such that the paper web P having reached the drum 10 is attracted to the suction surface. As the drum 10 rotates, the web P is fed to the rolling section 3. As the edged drum 11 rotates, in the meantime, the web P on the receiving drum 10 is cut into paper pieces of a predetermined length by the cutter blades of the drum 11. In this case, the paper web P is cut in a manner such that the cutter blades are not in contact with the receiving drum 11.

While successively receiving the pasted paper pieces from the receiving drum 10, therefore, the rolling section 3 can receive the intermediate products in succession.

At the rolling section 3, each paper piece is bonded to each intermediate product. As the product rolls on the rolling section 3, it is wound with the paper piece. In doing this, the paper piece is wound around that region of the intermediate product which covers its filter plug and the respective opposed end portions of the two cigarettes on the opposite sides. In this manner, a double filter cigarette is formed.

Further, a drum train 19, which extends to the left from the rolling section 3, is connected to a cigarette conveyor 20. This drum train 19 also includes a plurality of grooved drums, which are continuously located so as to be in rolling contact with one another. As its grooved drums rotate, the drum train 19 successively receives the double filter cigarettes from the rolling section 3, and transport them to the cigarette conveyor 20.

One grooved drum of the drum train 19 on the upper-course side is provided with a rotating knife 21. The knife 21 serves to cut each double filter cigarette into two equal parts. Thus, each double filter cigarette is cut in the center of its filter plug to be divided into two individual filter cigarettes.

Two grooved drums of the drum train 19, which successively adjoin the grooved drum with the rotating knife 12 on the left-hand side, constitute a separating drum assembly 22 which is similar to the separating drum assembly 5. As each two filter cigarettes pass through the drum assembly 22, therefore, they are separated in the axial direction from each other so that a predetermined space is formed between the two filter cigarettes.

Further, the grooved drum of the drum train 19 which is situated on the lower-course side of the separating drum assembly 22 constitute an inspection drum 23. As each two filter cigarettes pass through the inspection drum 23, they are subjected to an inspection to determine whether the paper pieces are wound normally.

Those filter cigarettes which have been determined to be rejectable on the inspection drum 23 are rejected to the outside of the drum train 19 without being fed to the cigarette conveyor 20, and only conforming filter cigarettes are fed from the drum train 19 to the conveyor 20. The cigarette conveyor 20 delivers the filter cigarettes to a packaging machine (not shown).

Figure 2:
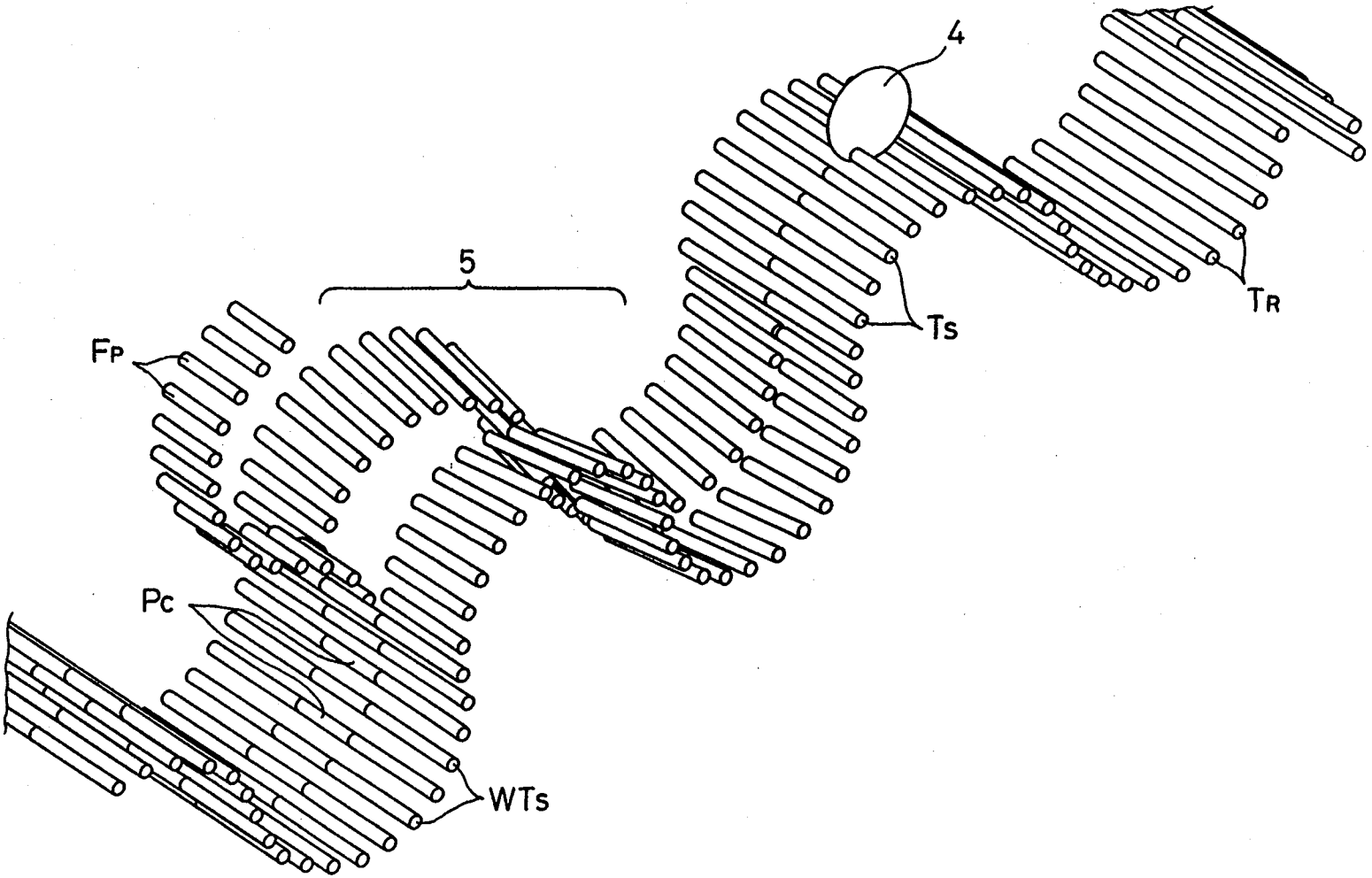
FIG. 2 is a perspective view showing a flow of transportation of cigarettes and filter cigarettes in the filter attachment.

Referring to FIG. 2, there are shown flows of cigarette rods $T_R$, cigarettes $T_s$, filter plugs $F_p$, and double filter cigarettes $WT_s$ which are transported from the drum train 2 through the rolling section 3 to the drum train 19. In FIG. 2, symbol $P_c$ designates a paper piece. In FIG. 2, moreover, the transportation path for the cigarettes, which is defined by the drum train 2, rolling section 3, and drum train 19, is turned inside out, as compared with the state shown in FIG. 1, in order to make clear the way the cigarette rods $T_R$ are cut by means of the rotating knife 4.

FIG. 2 further clearly illustrates the way each two cigarettes $T_s$ are separated in the axial direction from each other so that a space for each filter plug $F_p$ is formed between them as they pass through the separating drum assembly 5.

Figure 3:
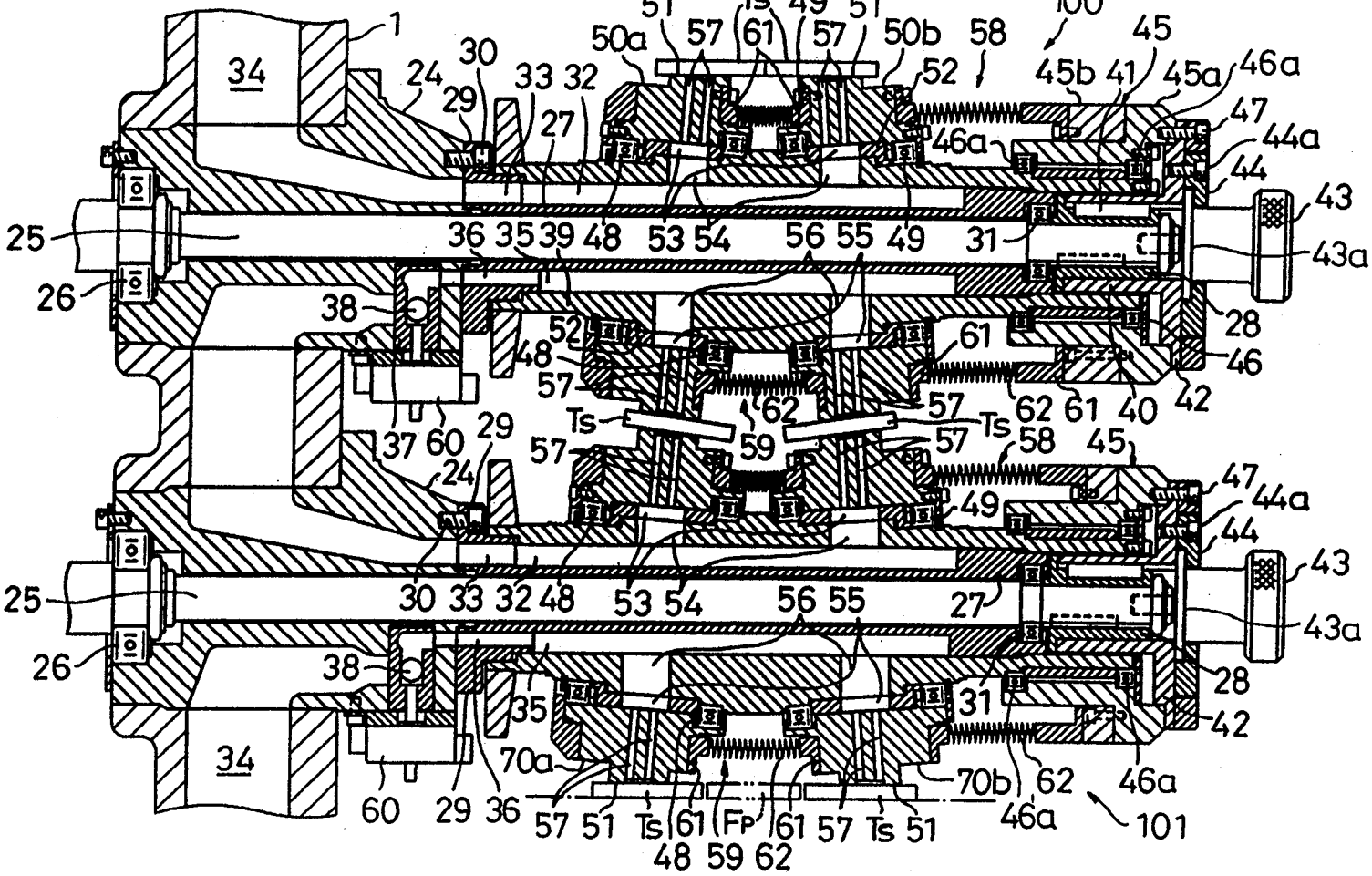
FIG. 3 is a sectional view showing a moving device according to a first embodiment of the present invention.

Referring to FIG. 3, there is shown a specific arrangement of the separating drum assembly 5. This drum assembly 5 includes a pair of drum units 100 and 101, which are arranged adjacent to each other with respect to the transportation direction of the cigarettes $T_s$. Since these drum units have substantially the same construction, only the drum unit 100 will be described hereinafter.

First, A support 24 is penetratingly attached to the main frame 1. A drive shaft 25 is rotatably supported in the support 24 by means of a bearing 26. The drive shaft 25 penetrates the support 24, and its one end portion or left-hand portion (as in FIG. 3) extends toward the inner part of the main frame 1. The one end of the shaft 25 is connected to a drive source (not shown) by means of a gear train (not shown). Thus, the drive shaft 25 is rotated in one direction by means of power from the drive source.

The other end of the drive shaft 25 projects long from the support 24 to the front side of the main frame 1. A fixed sleeve 27 and a driving sleeve 28 are successively mounted on the shaft 25, the former being located nearer to the support 24. A flange 29, which is formed on one end of the fixed sleeve 27, is fixed to the support 24 by means of a plurality of mounting screws 30. The other end of the sleeve 27 is rotatably supported on the drive shaft 25 by means of a bearing 31.

A channel-shaped suction passage 32 is formed on the outer peripheral surface of the fixed sleeve 27. The suction passage 32 extends in the axial direction of the sleeve 27, and also spreads in the circumferential direction to cover a predetermined region of the sleeve 27.

The suction passage 32 is connected to a connecting hole 33 which is formed in the one end of the fixed sleeve 27. The hole 33 is connected to a suction manifold 34 which is defined in the support 24 and the main frame 1, while the manifold 34 is connected to an air suction source or vacuum source (not shown).

Further, a channel-shaped atmosphere passage 35 is formed on the outer peripheral surface of the fixed sleeve 27. The atmosphere passage 35 and the suction passage 32 are separated from each other in the circumferential direction of the sleeve 27. Thus, the passage 35 is independent of the passage 32. The atmosphere passage 35 is connected to a connecting hole 36 which is formed in the one end of the sleeve 27. The hole 36 is alternatively connected to the suction manifold 34 in the support 24 or an atmosphere port 38 by means of a control valve 37.

More specifically, the control valve 37 is rotatably fitted in the support 24, and is connected to a rotary actuator 60 by means of a valve stem. The actuator 60 serves to rotate the control valve 37 around its axis, thereby allowing the connecting hole 36 to connect with the atmosphere port 38 or the suction manifold 34. Normally, the hole 36 is connected to the port 38, as shown in FIG. 3.

The fixed sleeve 27 is fitted with a hollow support shaft 39, which covers the suction passage 32, atmosphere passage 35, and driving sleeve 28. The support shaft 39 is fixed to the fixed sleeve 27 by screwing.

An intermediate sleeve 40 is interposed between the support shaft 39 and the driving sleeve 28. The sleeve 40 is connected to the sleeve 28 by means of a key 41. The sleeve 40 projects from the support shaft 39, and a flange 42 is formed integrally on the projecting end of the sleeve 40.

A knob 43 is fixed to the other end of the drive shaft 25 by screwing. The knob 43 includes a flange-shaped projection **43*a* on its peripheral surface, a coupling disk 44, and a coupling ring 46 mounted on the outer peripheral surface of the disk 44. The coupling disk 44 is coupled to the flange 42 of the intermediate sleeve 40 by means of a plurality of coupling screws 44*a*, whereby the projection 43*a* of the knob 43 is held between the sleeve 40 and the disk 44**.

A rotor 45 is rotatably mounted, by means of a pair of bearings **46*a*, on that end portion of the support shaft 39 which is situated on the side of the intermediate sleeve 40. The rotor 45 is coupled to the flange 42 of the sleeve 40 and the coupling ring 46 by means of a plurality of coupling screws 47**.

The rotor 45 includes a stepped hollow cylinder **45*a* and a ring 45*b* fitted integrally on a small-diameter portion of the cylinder 45*a***.

The support shaft 39 has a pair of conical drums **50*a* and 50*b* on the central portion thereof. The drums 50*a* and 50*b* are rotatably supported on the shaft 39 by means of a pair of bearings 48 and another pair of bearings 49, respectively. These conical drums 50*a* and 50*b* have their respective large-diameter ends facing each other, and their axes are oppositely inclined at a predetermined angle to the axis of the support shaft 39**.

More specifically, the conical drums **50*a* and 50*b* are inclined so that those conical surfaces close to that upper-course-side grooved drum which adjoins the drums 50*a* and 50*b*** are parallel to the outer peripheral surface of the upper-course-side grooved drum.

In order to mount the conical drums **50*a* and 50*b* on the support shaft 39 in the aforesaid manner, the respective mounting surfaces for the drums 50*a* and 50*b* or the bearings 48 and 49, on the shaft 39**, are tapered.

Since the conical drums **50*a* and 50*b* are inclined in this manner, the distance between the drums 50*a* and 50*b* gradually increases in the aforesaid cigarette transportation direction, as seen from FIG. 3**.

Each of the conical drums **50*a* and 50*b* has a plurality of grooves 51 on its outer peripheral surface or conical surface. These grooves 51**, each extending parallel to the axis of the conical drum, are arranged at regular intervals in the circumferential direction of the drum.

Control rings 52, which are interposed between the support shaft 39 and the individual conical drums, are fixed to the shaft 39. Thus, the conical drums **50*a* and 50*b* can rotate in sliding contact with their corresponding control rings 52**.

Each control ring 52 has a suction port 53, which extends over a predetermined rotational-angle region of the drive shaft 25 with respect to the circumferential direction of the ring 52. The port 53 is connected to the suction passage 32 by means of a communication hole 54 in the support shaft 39.

Further, each control ring 52 has an atmosphere port 55, which, independent of the suction port 53, also extends over a predetermined rotational-angle region of the drive shaft 25 with respect to the circumferential direction of the ring 52. The port 55 is connected to the atmosphere passage 35 by means of a communication hole 56 in the support shaft 39.

Meanwhile, a pair of communication passages 57 are formed for each groove 51 in each of the conical drums **50*a* and 50*b*. These passages 57 diametrically extend in each conical drum 50. One end of each communication passage 57 opens in the bottom of its corresponding groove 51, and the other end in the inner peripheral surface of the conical drum 50. Thus, the passage 57 can be alternatively connected to the suction port 53 or the atmosphere port 55 of the control ring 52. As each conical drum rotates, therefore, the paired communication passages 57 for each groove 51 are connected to the suction passage 32 or the atmosphere passage 35 by means of the suction port 53 or the atmosphere port 55 of the control ring 52**.

Figure 4:
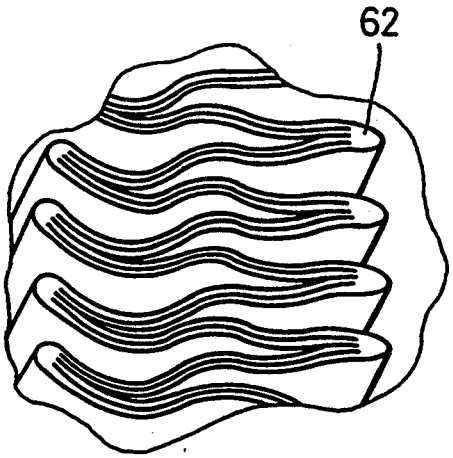
FIG. 4 is a cutaway perspective view showing a bellows of a coupling.

The rotor 45 and the conical drum **50*b* is coupled to each other by means of a coupling 58, while the conical drums 50*a* and 50*b* are coupled by means of a coupling 59. Each of these couplings 58 and 59 includes a bellows 62 and end rings 61 attached individually to the opposite ends of the bellows 62. The rings 61 and the bellows 62 are formed of stainless steel. As shown in FIG. 4, each bellows 62 has a double structure, so that the couplings 58 and 59** can enjoy a high torsional rigidity without abandoning their flexibility.

The coupling 58 couples the rotor 45 and the conical drum **50*b* to each other in a manner such that the end rings 61 are fixed to the rotor 45 and the drum 50*b*, individually. Further, the coupling 59 couples the conical drums 50*a* and 50*b* to each other in a manner such that the end rings 61 are fixed to the drums 50*a* and 50*b***, individually.

When the drive shaft 25 is rotated, this rotation is transmitted to the rotor 45 through the driving sleeve 28 and the intermediate sleeve 40, whereupon the rotor 45 rotates integrally with the shaft 25.

The rotation of the rotor 45 is transmitted to the conical drum **50*b* through the coupling 58, and is further transmitted from the drum 50*b* to the conical drum 50*a* through the coupling 59. Thus, as the rotor 45 rotates, the paired conical drums 50*a* and 50*b*** are rotated at equal speeds.

As mentioned before, the drum unit 101 has substantially the same construction as the drum unit 100. In the description of the drum unit 101 shown in FIG. 3, therefore, like reference numerals are used to designate those members which have the same functions as the members of drum unit 100, and a description of those similar members is omitted. The following is a description of only differences between the drum units 100 and 101.

The drum unit 101 includes a pair of conical drums 70*a* and 70*b* which are located so as to be in rolling contact with the conical drums 50*a* and 50*b*, respectively. The drums 70*a* and 70*b* are rotated oppositely to and at the same peripheral speed as the drums 50*a* and 50*b*.

As seen from FIG. 3, the conical drums 70*a* and 70*b* are directed oppositely to their corresponding conical drums 50*a* and 50*b* with respect to the axial direction. Further, the respective axes of the drums 70*a* and 70*b* are parallel to those of the drums 50*a* and 50*b*, respectively.

Thus, the conical surfaces of the conical drums 70*a* and 70*b*, which are close to their corresponding drums 50*a* and 50*b*, are parallel to the conical surfaces of the drums 50*a* and 50*b*, respectively.

Also, the conical surfaces of the conical drums 70*a* and 70*b*, which are close to that lower-course-side grooved drum adjoining the conical drums 70*a* and 70*b*, are parallel to the peripheral surface of that grooved drum.

The distance between the conical drums 70*a* and 70*b*, arranged in this manner, also gradually increases in the aforesaid cigarette transportation direction.

According to the separating drum assembly 5 described above, the paired conical drums 50*a* and 50*b* of the drum unit 100 can receive each two cigarettes $T_s$ from the upper-course-side grooved drum to their grooves 51 by suction. At this point of time, the grooves 51 of the conical drums are connected to the suction ports 53 of the control rings 52 or the suction passage 32 by means of the paired communication passages 57.

As the conical drums 50*a* and 50*b* rotate, the two cigarettes $T_s$, received from the upper-course-side grooved drum to the drums 50*a* and 50*b*, are transported to their corresponding conical drums 70*a* and 70*b*. During this transportation, the distance between the cigarettes $T_s$ gradually increases with the inclination of the drums 50*a* and 50*b* (see FIG. 2).

When the two cigarettes $T_s$ reach the close points between the conical drums 50 and the drums 70, thereafter, the drums 70*a* and 70*b* can receive each two cigarettes $T_s$ in like manner from the drums 50*a* and 50*b* to their grooves 51 by suction.

More specifically, the suction of the cigarettes $T_s$ on the side of the conical drums 50*a* and 50*b* is continued till the time immediately before the cigarettes $T_s$ are received by the conical drums 70*a* and 70*b*. By the time when the cigarettes $T_s$ from the drums 50*a* and 50*b* are received by the drums 70*a* and 70*b*, however, the cigarettes $T_s$ are already released from the suction on the side of the drums 50*a* and 50*b*. At this point of time, the grooves 51 of the drums 50*a* and 50*b* in which the cigarettes $T_s$ are received are connected to the atmosphere ports 55 of the control ring 52 or the atmosphere passage 35 by means of the communication passages 57.

The grooves 51 of the conical drums 70*a* and 70*b* which are to receive the cigarettes $T_s$, on the other hand, are connected to the suction passage 32, so that the cigarettes $T_s$ can be securely delivered from the drums 50 to the drum 70.

As the conical drums 70*a* and 70*b* rotate, the two cigarettes $T_s$ received to the drums 70*a* and 70*b* are transported to the lower-course-side grooved drum. During this transportation, the distance between the cigarettes $T_s$ further increases (see FIG. 2).

Thereafter, the two cigarettes $T_s$ on the conical drums 70*a* and 70*b* are delivered to the lower-course-side grooved drum in like manner, and are transported to the rolling section 3.

When the two cigarettes $T_s$ are transferred from the conical drums $70_a$ and $70_b$ to the lower-course-side grooved drum, a space wide enough to receive each filter plug $F_p$ is secured between the cigarettes as shown in FIG. 3.

Since the separating drum assembly 22 has a construction similar to that of the separating drum assembly 5, illustration and description of the assembly 22 are omitted herein.

According to the separating drum assembly 5 described above, the bellows-type couplings 58 and 59 are used to transmit power to the conical drums 50 and 70, providing the following advantages.

In connection with the drum unit 100, the conical drums 50*a* and 50*b* and also the conical drum 50*b* and the rotor 45 can be easily coupled to each other by means of the bellows 62 of the coupling 58 and 59, respectively, without regard to the presence of an angle of deviation between the respective axes of the conical drums 50*a* and 50*b* or between the respective axes of the drum 50*b* and the rotor 45.

Since the couplings 58 and 59 are not subject to any problem of backlash caused by the engagement of paired bevel gears, the rotating speeds of the conical drums 50 and 70 are highly accurately and stable. Accordingly, the cigarettes Ts can be securely delivered between the grooved drums and the conical drums and between the conical drums. Further, the couplings 58 and 59 require neither lubrication nor additional use of dust-proof members for the couplings. Therefore, the power transmission systems for the conical drums are very simple in construction, and their maintenance is easy.

The couplings 58 and 59 absorb errors in the working and assembling accuracy of members and components surrounding them as their bellows 62 extend and contract. Thus, these members and components, that is, the conical drums and the rotor etc,, can be easily assembled and disassembled in a short period of time.

The use of the couplings 58 and 59 obviates the necessity of dust-proof rubber covers and bearings which are required by the bevel gears. Accordingly, there is no need of any replacement work for the rubber covers, bearings, or other expendables, so that the operational reliability, as well as the operating efficiency, of the filter attachment is improved.

If the length of the filter plug $F_p$ is changed, then the space to be secured between the two cigarettes $T_s$ must inevitably be changed. This change requires replacement of the conical drums and other components. In this case, however, the couplings 58 and 59 can be used in common, so that the number of required replacement parts can be reduced. Accordingly, the general-purpose properties of the filter attachment for the manufacture of filter cigarettes of different brands are improved.

It is needless to say that the couplings 58 and 59 of the drum unit 101 have the same advantages described above.

Figure 5:
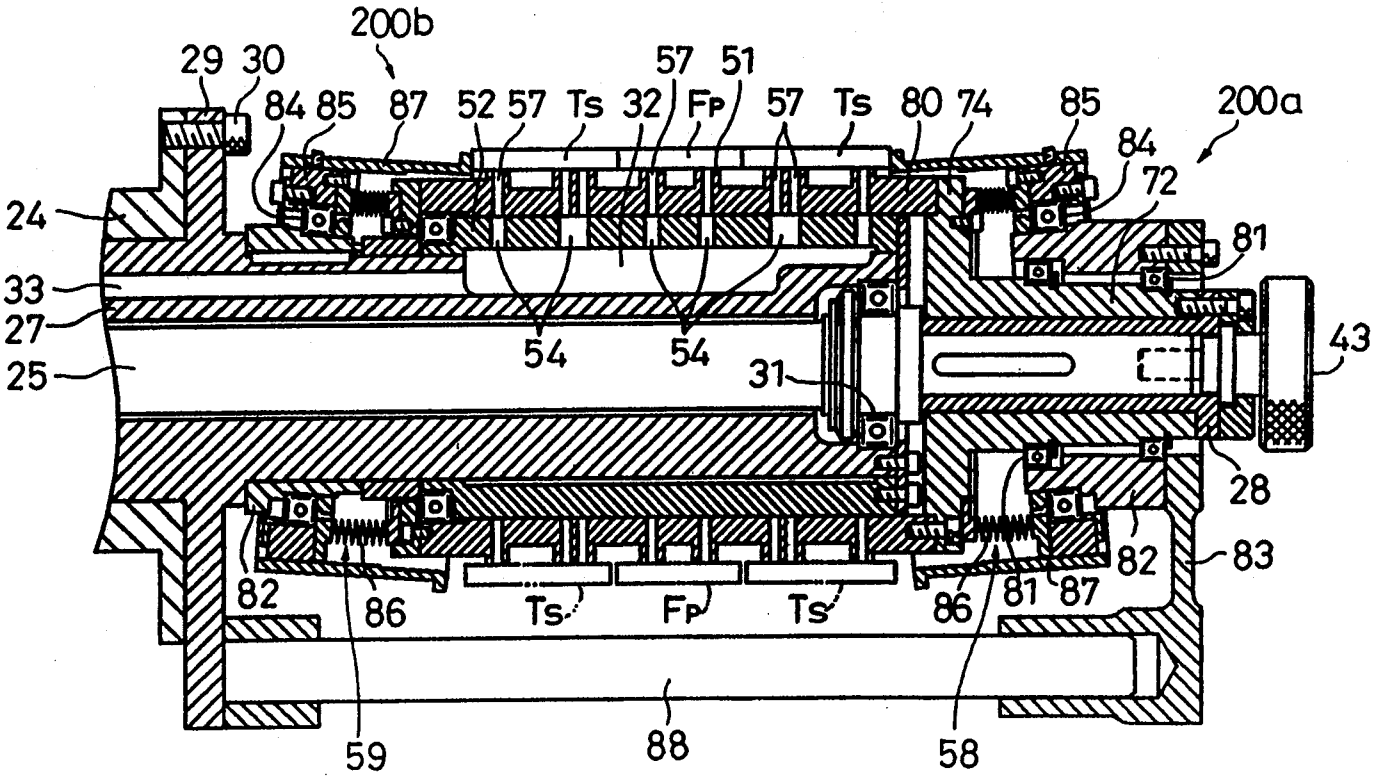
FIG. 5 is a sectional view showing a moving device according to a second embodiment.

The present invention is not limited to the first embodiment described above, and various changes and modifications may be effected therein. In the first embodiment, the moving devices of the present invention are incorporated in the separating drum assemblies 5 and 22. Alternatively, however, the moving devices of the invention may be incorporated in one of the grooved drums of the drum train 2, or more specifically, that grooved drum 80 (see FIG. 1) which adjoins the rolling section 3. FIG. 5 illustrates an example of this arrangement.

The grooved drum 80 of FIG. 5 is provided with a pair of moving devices 200*a* and 200*b* individually on the two opposite ends thereof. As each intermediate product, which includes two cigarettes $T_s$ and a filter plug $F_p$ between them, is transported on the drum 80, the paired moving devices 200*a* and 200*b* move the two cigarettes $T_s$ of the intermediate product in the axial direction thereof, thereby bringing the cigarettes into intimate contact with the filter plug and positioning the intermediate product.

in the description of a supporting structure for the grooved drum 80 to follow, like reference numerals are used to designate those members and parts which have the same functions as the members and parts of the aforementioned separating drum assemblies.

As shown in FIG. 5, a control ring 52 is mounted directly on a fixed sleeve 27. The ring 52 covers a suction passage 32 of the sleeve 27, and a plurality of suction ports 54 of the ring 52 is connected to the passage 32.

The grooved drum 80 is rotatably mounted on the control ring 52. The drum 80 and a drive shaft 25 are arranged coaxially with each other.

A driving sleeve 28 is fitted with a rotor 72, which is coupled to the grooved drum 80 by means of its flange 74. Further, the rotor 72 is coupled to the drive shaft 25 by means of a knob 43 and the driving sleeve 28. Thus, the rotatory force of the shaft 25 is transmitted to the drum 80 via the rotor 72, whereby the drum 80 is rotated together with the shaft 25.

The one moving device 200*a* comprises a support ring 82 which is mounted on the rotor 72 by means of a pair of bearings 81. A fixed arm 83 is coupled to the ring 82. The arm 83 and a flange 29 of the fixed sleeve 27 are coupled to each other by means of a rod 88. Thus, the support ring 82 is fixed.

A tilted ring 85 is rotatably supported on the support ring 82 by means of a bearing 84. The axis of the ring 85 is inclined at a predetermined angle to that of the drive shaft 25 or the grooved drum 80.

The tilted ring 85 and the flange 74 of the rotor 72 are coupled to each other by means of a bellows-type coupling 86 which resembles the aforementioned couplings 58 and 59. Thus, the ring 85 is also rotated at the same speed with the rotor 72 and the grooved drum 80.

A pusher drum 87 is fixedly mounted on the outer peripheral surface of the tilted ring 85. The drum 87 is in the form of a hollow cylinder which is open at both ends. The pusher drum 87 extends toward the grooved drum 80, and covers an end portion of the drum 80.

When the pusher drum 87 is fitted on the tilted ring 85, as seen from FIG. 5, its axis is inclined against the axis of the grooved drum 80. When the drums 80 and 87 are rotated at equal speeds in this state, therefore, the open end of the drum 87 rotates within a plane inclined against the cross section of the drum 80.

The other moving device 200*b* differs from the aforementioned moving device 200*a* only in that it is laterally reversed with respect to the axial direction of the grooved drum 80, and that its support ring 82 is fixed to the fixed sleeve 27.

The intermediate product is received in grooves 51 of the grooved drum 80, as indicated by two-dot chain lines in FIG. 5. When the intermediate product is transported to a predetermined rotational-angle position of the drum 80 as the drum 80 rotates, the open ends of the corresponding pusher drums 87 are pressed against the two cigarettes $T_s$ of the product. Thereupon, these cigarettes $T_s$ axially move in the grooves 51 and come into intimate contact with the opposite ends of the filter plug $F_p$. At the same time, the intermediate product is located in a predetermined position with respect to the axial direction of the grooved drum 80.

Thus, the intermediate product on the grooved drum 80 is positioned in a manner such that the two cigarettes $T_s$ thereof are held between the paired pusher drums 87.

Since the open ends of the pusher drums 87 move at the same speed with the cigarettes $T_s$ transported on the grooved drum 80, the end faces of the cigarettes $T_s$ are prevented from coming into sliding contact with the drums 87. Accordingly, cut tobacco cannot slip out from the end faces of the cigarettes $T_s$.

When the intermediate product is received by the grooved drum 80, the distance between the respective open ends of the pusher drums 87 is extended, so that the drums 87 never hinder the transfer of the intermediate product to the grooved drum 80.

Thereafter, the positioned intermediate product is fed from the grooved drum 80 to the rolling section 3.

Figure 6:
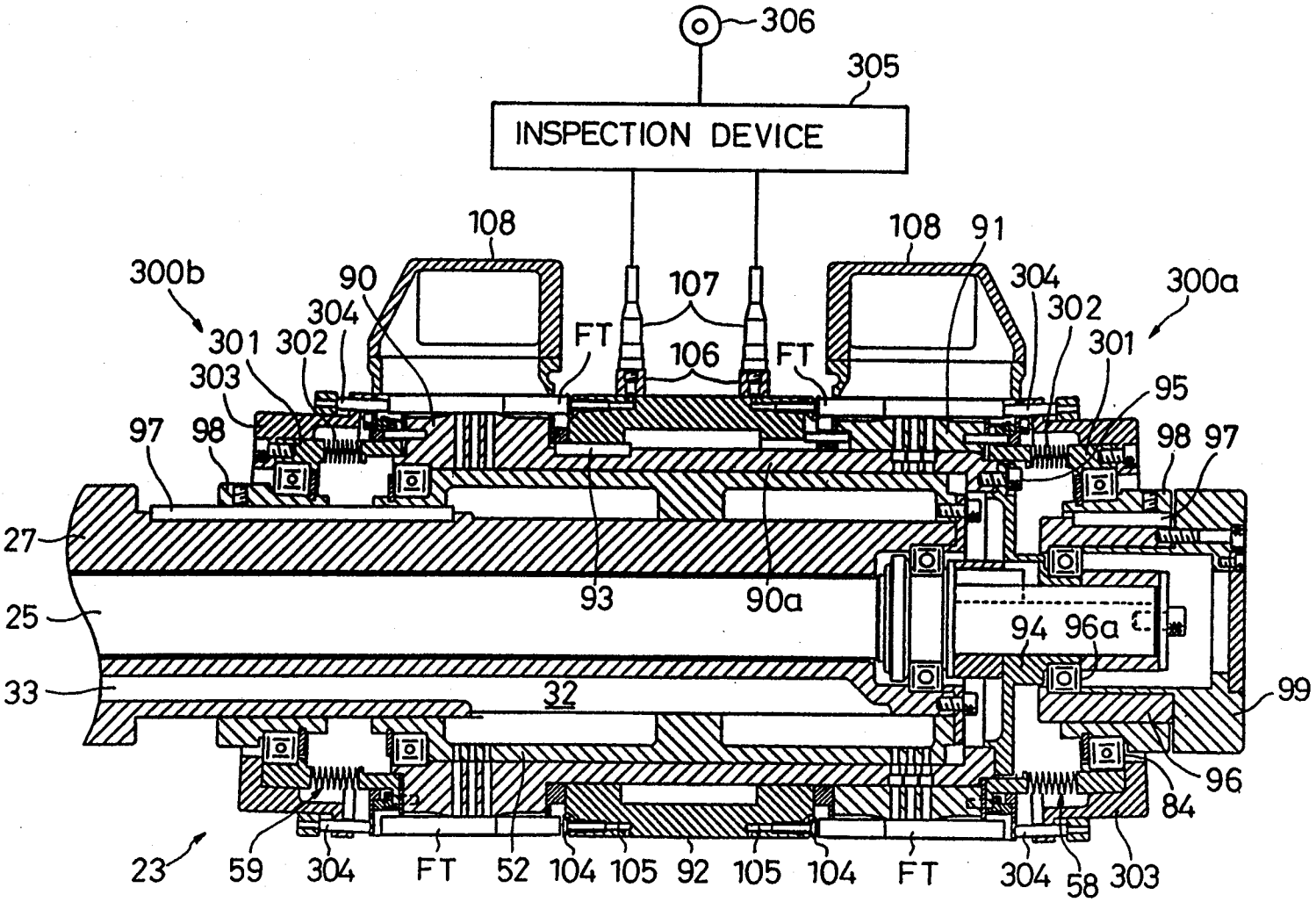
FIG. 6 is a sectional view showing a moving device according to a third embodiment.

The moving devices of the present invention are also incorporated in the inspection drum 23 or inspection drum assembly. FIG. 6 shows the details of the drum assembly 23.

The inspection drum assembly 23 of FIG. 6 includes a pair of grooved drums 90 and 91, which are spaced in the axial direction of its drive shaft 25. Accordingly, the grooved drums 90 and 91 can individually receive in their respective grooves two filter cigarettes FT transported thereto after being separated by the separating drum assembly 22.

The grooved drum 90 has a shaft portion 90*a* which extends to the grooved drum 91, and the drum 91 is fixed on the shaft portion 90*a*.

A center drum 92, which is interposed between the grooved drums 90 and 91, is fixed to the shaft portion 90*a* of the grooved drum 90 by means of a key 93. Thus, the center drum 92 and the grooved drum 91 are rotated integrally with the grooved drum 90.

A driving disk 94, which is mounted on the drive shaft 25, is coupled to the shaft portion 90*a* of the grooved drum 90 by means of a plurality of coupling screws 95. Thus, the rotatory force of the drive shaft 25 is transmitted to the drum 90 via the disk 94, so that the drum 90 is rotated together with the grooved drum 91 and the center drum 92.

The grooved drums 90 and 91 are combined with moving devices which are similar to the moving devices 200 described above. First, a moving device 300*a* on the side of the grooved drum 91 is provided with an inner support ring 96, which is mounted on a boss of the driving disk 94 by means of a bearing 96*a*. An outer support ring 98 is mounted on the ring 96 by means of a key 97. The inner support ring 96 is fixed to a fixing member 99, which supports the ring 96.

The outer support ring 98 is fitted with a tilted ring 301, a coupling 302, and a pusher drum 303, which correspond to the tilted ring 85, the coupling 86, and the pusher drum 87, respectively. In this case, the coupling 302 couples the ring 301 and the grooved drum 91.

Thus, when the rotatory force of the drum 91 is transmitted to the tilted ring 301 or the pusher drum 303 via the coupling 302, the drum 303 is also rotated.

The pusher drum 303, unlike the pusher drum 87, has a plurality of pusher pins 304 on its open end. These pins 304, which are arranged at regular intervals in the circumferential direction of the drum 303, project toward their corresponding grooves of the grooved drum 91.

A moving device **300*b* on the side of the grooved drum 90 differs from the moving device 300*a* only in the lateral orientation and in that the inner support ring 96 is omitted. In this case, a support ring 98 of the device 300*b* is mounted on the fixed sleeve 27 by means of a key 97**.

A plurality of inspection sockets 104 are provided on each end face of the center drum 92. These sockets 104, which are arranged at regular intervals in the circumferential direction of the drum 92, also project toward their corresponding grooves of the grooved drums 90 and 91. Those inspection sockets 104 on one end face of the center drum 92 are connected individually to passages 105 in the drum 92. These passages 105 open in the outer peripheral surface of the drum 92. The respective openings of the passages 105 are distributed at regular intervals in the circumferential direction of the center drum 92 and on the circumference of the same circle. The inspection sockets 104 on the other end face of the drum 92 are also connected individually to passages 105, which also open in the outer peripheral surface of the drum 92.

A pair of connectors 106 abut against the outer peripheral surface of the center drum 92. The drum 92 rotates with its outer peripheral surface in sliding contact with the connectors 106. As the drum 92 rotates in this manner, the passages 105 which open on the circumference of the same circle, that is, the inspection sockets 104, are successively connected to their corresponding connectors 106.

A suction hose 107 extends from each connector 106. The hoses 107 are connected to a negative pressure source 306 through an inspection device 305. Thus, when the center drum 92 is rotated, the inspection sockets 104 are successively connected to the inspection device 305 and the negative pressure source 306, by means of the connectors 106.

When each two filter cigarettes FT are fed into the grooves of the grooved drums 90 and 91, they are transported as the drums 90 and 91 rotate. During this transportation, the filter cigarettes FT are pressed against the inspection sockets 104 by their corresponding pusher pins 304 of the pusher drums 303, whereby they are held between the sockets 104 and the pins 304. At this time, the inspection sockets 104 are connected to the negative pressure source 306 and the inspection device 305 by means of the connectors 106 and the suction hoses 107, so that air is sucked in through the filter cigarettes FT. Based on the pressure of the air sucked in through the filter cigarettes FT, the inspection device 305 detects dilution of the filter cigarettes. This dilution indicates the degree to which smoke flowing into the mouth of a smoker is thinned as a filter cigarette is smoked. Thus, the dilution serves as an index by which whether the paper piece $P_c$ of the filter cigarette is wound properly or not is determined.

After undergoing an inspection, thereafter, the two filter cigarettes FT are transferred from the inspection drum assembly 23 to the next grooved drum.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A power transmission device for a filter cigarette manufacturing system, said power transmission device comprising:

a power transmission line;

first and second rotating member arranged side by side in the power transmission line so that an angle is secured between respective axes of said first and second rotating members; and coupling means for rotating said first and second rotating members at equal speeds, said coupling means including a bellows coupling said first and second rotating members and exclusively transmitting a torque of one of said rotating member to the other while maintaining the angle between the axes of said first and second rotating members.

2. A device for moving products in an axial direction thereof, the products being cigarettes supplied to a filter cigarette manufacturing system or filter cigarettes produced in the system, said device comprising:

a rotatable grooved drum having an outer peripheral surface adapted to transport the products in a direction perpendicular to the axial direction thereof while rotating;

a rotating member located on one side of said grooved drum at a distance therefrom, an angle being secured between the respective axes of said rotating member and said grooved drum;

coupling means for rotating said rotating member and said grooved drum at equal speeds, said coupling means including a bellows coupling said rotating member and said grooved drum and transmitting a torque from one of said rotating member and grooved drum to the other while maintaining the angle between the axes of said rotating member and said grooved drum; and a pusher member fixed to said rotating member and extending from said rotating member to a position right over the outer peripheral surface of said grooved drum, said pusher member pushing out the products, being transported on said grooved drum, in the axial direction thereof when a predetermined rotational angle region of said grooved drum is reached by the products on said drum.

3. The device according to claim 2, wherein said grooved drum transports together two cigarettes axially aligned with each other and with a predetermined axial space therebetween, along with a filter plug situated in the space between the cigarettes and having two opposite ends and a length twice that of each of filters of the filter cigarettes, as said grooved drum rotates, and which further comprises:

a second rotating member located on the other side of said grooved drum at a distance therefrom, an angle being secured between the respective axes of said second rotating member and said grooved drum;

second coupling means for rotating said second rotating member and said grooved drum at equal speeds, said second coupling means including a second bellows coupling said second rotating member and said grooved drum and transmitting a torque from one of said second rotating member and grooved drum to the other while maintaining the angle between the axes of said second rotating member and said grooved drum; and a second pusher member fixed to said second rotating member and extending from said second rotating member to a position right over the outer peripheral surface of said grooved drum, said first and second pusher members pushing out the two cigarettes in opposite directions to bring the cigarettes individually into intimate contact with the opposite ends of the filter plug between the cigarettes when the rotational angle region of said grooved drum is reached by the two cigarettes and filter plug transported on said grooved drum.

4. The device according to claim 3, wherein each of said first and second bellows has double walls.

5. The device according to claim 3, wherein said pusher member includes a hollow pusher drum extending from said rotating member toward said grooved drum and inclined against said grooved drum, said pusher drum having an open end surrounding an end portion of said grooved drum.

6. The device according to claim 2, wherein said grooved drum has a rand portion in the center of the outer peripheral surface thereof with respect to the axial direction, and transports together two filter cigarettes axially aligned with each other on either side of the rand portion and having filter thereof directed to the rand portion, as said grooved drum rotates, and which further comprises:

a second rotating member located on the other side of said grooved drum at a distance therefrom, an angle being secured between the respective axes of said second rotating member and said grooved drum;

second coupling means for rotating said second rotating member and said grooved drum at equal speeds, said second coupling means including a second bellows coupling said second rotating member and said grooved drum and transmitting a torque from one of said second rotating member and grooved drum to the other while maintaining the angle between the axes of said second rotating member and said grooved drum; and a second pusher member fixed to said second rotating member and extending from said second rotating member to a position right over the outer peripheral surface of said grooved drum, said first and second pusher members pushing out the two cigarettes in opposite directions to bring the cigarettes individually into intimate contact with the rand portion when the rotational angle region of said grooved drum is reached by the two cigarettes and filter plug transported on said grooved drum.

7. The device according to claim 6, wherein said rand portion has two ring-shaped opposite end faces, and said grooved drum further comprises:

sockets provided on the opposite end faces of said rand portion, said sockets receiving the filters of the filter cigarettes when the filter cigarettes are pushed out by said first and second pusher member; and an inspection means for inspecting the filter cigarettes by pneumatically connecting the filter cigarette to the corresponding socket when the end face of the filter of the filter cigarette is received by the socket.

8. The device according to claim 7, wherein each of said first and second bellows has double walls.

9. The device according to claim 7, wherein each of said first and second pusher member is a hollow pusher drum extending from the corresponding rotating member toward said grooved drum and inclined against said grooved drum, the pusher drum having an open end and surrounding one end portion of said grooved drum, and includes a plurality of pins projecting from the open end of the pusher drum and adapted to push out the filter cigarettes.

10. A device for separating two aligned products in the axial direction thereof to form a space between the products, the products being cigarettes supplied to a filter cigarette manufacturing system or filter cigarettes produced in the system, said device comprising:

a first fixed shaft;

a pair of first conical drums rotatably mounted on said first fixed shaft and directed opposite to each other, said first conical drums being adapted individually to receive the two axially aligned products to be separated and transport the products when rotated in the same direction, and respective axes of rotation of said first conical drums being including opposite to each other against the axis of said first fixed shaft so that the products transported by means of said first conical drums are separated from each other;

a first rotor member mounted coaxially on said first fixed shaft so as to be rotatable in one direction, said first rotor member being located beside said paired first conical drums, and an angle being secured between the respective axes of said first rotor member and one of said first conical drums which adjoins said first member;

first coupling means for rotating said paired first conical drums and said first rotor member at equal speeds, said first coupling means including a pair of first bellows for making connections between said first rotor member and the one first conical drum and between said paired first conical drums and exclusively transmitting a rotatory force from said first rotor member to the one of said paired first conical drums and the one first conical drum to the other first conical drum while maintaining the angles between the axes of said first rotor member and the one first conical drum and between the axes of said paired first conical drums, individually;

a second fixed shaft parallel to said first fixed shaft;

a pair of second conical drums rotatably mounted on said second fixed shaft and directed opposite to each other, said second conical drums being adapted individually to receive the two products from said paired first conical drums and transport the products when rotated in the direction opposite to said first conical drums, and the respective axes of said second conical drums being inclined opposite to each other against the axis of said second fixed shaft so that the two received products are further separated and aligned again on the same axis with each other;

a second rotor member mounted coaxially on said second fixed shaft so as to be rotatable in the direction opposite to that of said first rotor member, said second rotor member being located beside said paired second conical drums, and an angle being secured between the respective axes of said second rotor member and one of said second conical drums which adjoins said rotor member; and second coupling means for rotating said paired second conical drums and said second rotor member at equal speeds, said second coupling means including a pair of second bellows for making connections between said second rotor member and the one second conical drum and between said paired second conical drums and exclusively transmitting a rotatory force from said second rotor member to the one of said paired second conical drums and the one second conical drum to the other second conical drum while maintaining the angles between the axes of said second rotor member and the one second conical drum and between the axes of said paired second conical drums, individually.

11. The device according to claim 10, wherein said first and second bellows coaxially extend relative to the axes of said first and second fixed shafts.

12. The device according to claim 11, wherein said first and second bellows have double walls.

* * * * *